United States Patent [19]

Thompson

[11] 4,375,440

[45] Mar. 1, 1983

[54] SPLAT COOLING OF LIQUID METAL DROPLETS

[75] Inventor: Charles C. Thompson, Jupiter, Fla.

[73] Assignee: United Technologies Corporation, Hartford, Conn.

[21] Appl. No.: 50,842

[22] Filed: Jun. 20, 1979

[51] Int. Cl.[3] ..... B22D 9/10

[52] U.S. Cl. ..... 264/12; 164/46; 164/348; 425/8; 264/8

[58] Field of Search ..... 164/46, 87, 427, 429, 164/348; 264/12, 5, 8, 10, 13; 425/6, 8

[56] References Cited

U.S. PATENT DOCUMENTS

| | | | |
|---|---|---|---|
| 2,961,720 | 11/1960 | Rayburn | 425/6 |
| 4,025,249 | 5/1977 | King | 425/6 |
| 4,078,873 | 3/1978 | Holiday et al. | 425/8 |
| 4,140,462 | 2/1979 | Thompson | 425/8 |
| 4,259,270 | 3/1981 | Winter et al. | 164/52 X |

FOREIGN PATENT DOCUMENTS

| | | | |
|---|---|---|---|
| 51-1718 | 1/1976 | Japan | 264/8 |

*Primary Examiner*—Gus T. Hampilos
*Assistant Examiner*—K. Y. Lin
*Attorney, Agent, or Firm*—Jack N. McCarthy

[57] ABSTRACT

An apparatus is set forth for the continuous production of highly cooled metal splats. Melted metal is poured onto a spinning atomization disc means whereby liquid metal droplets leave the disc means in a horizontal plane. An annular cooling gas jet flowing normal to the particle plane around the disc deflects the heavier liquid droplets to a conical splat plate which is fixed to rotate with said disc, where the droplets splat and cool, and are ejected by centrifugal force. An annular space is located between said conical splat plate and said rotary atomization means for permitting the gas and other solidified particles to pass downwardly to a shield which directs the particles to a collection area.

10 Claims, 3 Drawing Figures

SPLAT COOLING OF LIQUID METAL DROPLETS

BACKGROUND OF THE INVENTION

This invention relates to the formation of metal splats, or splatter, which is cooled at a very high rate.

Metal particulate matter have been previously formed in the prior art by various methods. Known representative patents are set forth below: U.S. Pat. Nos. 3,721,511; 4,027,718; and 4,078,873.

SUMMARY OF THE INVENTION

According to the present invention, an apparatus is set forth which will produce a large quantity of splatter which is cooled at a very high controlled rate.

It is an object of this invention to provide an apparatus in which molten metal is poured on a spinning disc and flung off into a flowing annular curtain of coolant, said molten metal being flung outwardly in droplets and diverted downwardly by the annular curtain against the side of a conical splat plate. A liquid metal droplet is impacted onto the splat plate and spread into a splat (flattened droplet) a few microns thick.

It is a further object of this invention to have the conical splat plate spinning with the disc. The droplets form splats upon impact with the inner surface of the conical splat plate; they cool fast; and as they cool, they shrink from the surface and are ejected by the action of centrifugal force.

It is another object of the invention to provide for cooling of the conical splat plate.

It is a further object of the invention to provide an annular opening between the rotating drive shaft and connected conical splat plate below the flowing annular jet to permit the smaller gas-quenched particles to be removed downwardly over a deflector shield for flow to a collector. The deflector shield also protects the pedestal from small particles getting into the rotation mount or air turbine device.

It is another object of this invention to provide a method of forming metal splats where liquid metal droplets are flung outwardly while a gas blowing downwardly on said droplets deflects them onto a flat surface where they flatten and cool and the splat surface is rotated to insure ejection of formed splats.

DESCRIPTION OF THE PREFERRED EMBODIMENT

Figure 1:
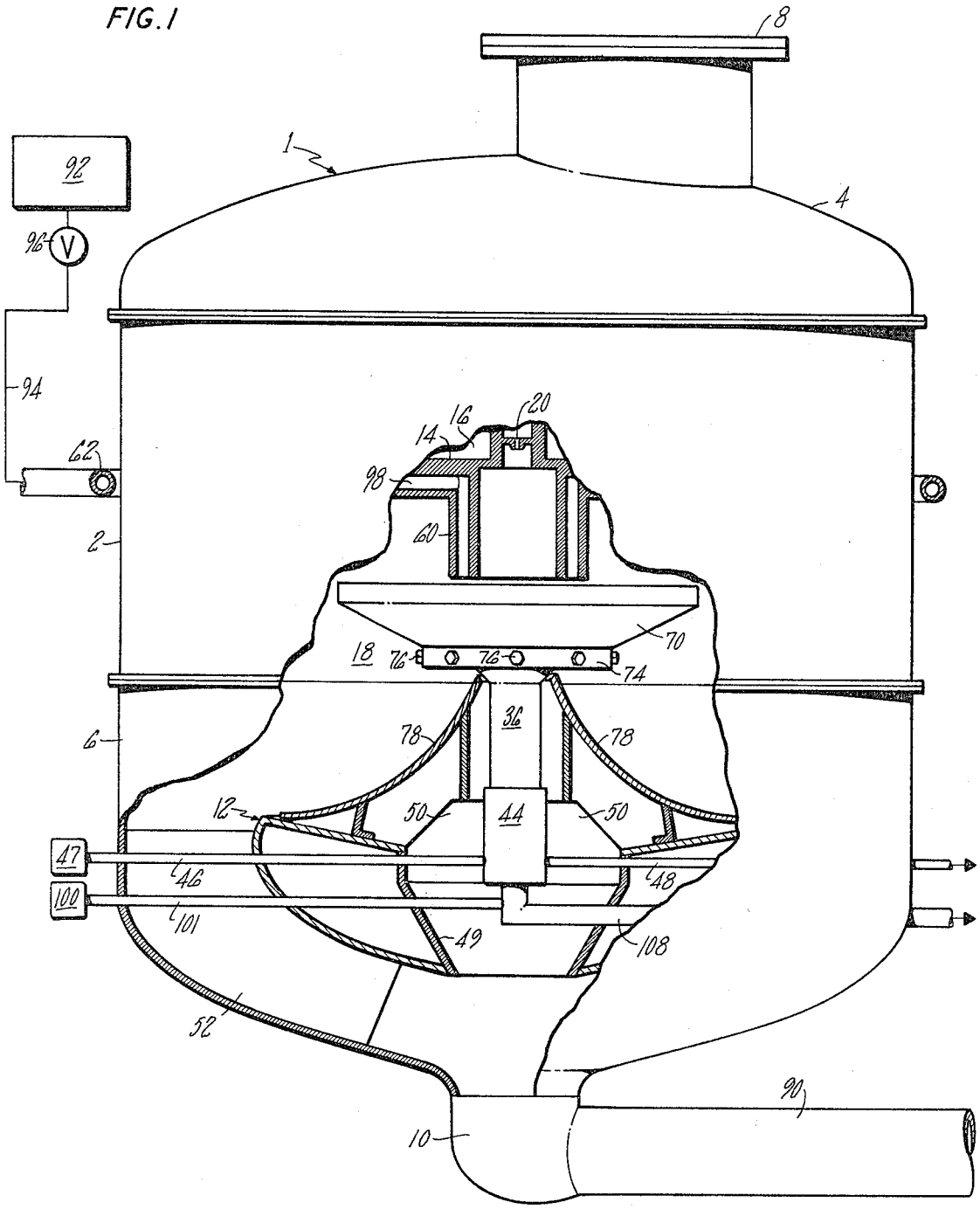
FIG. 1 is a view of an apparatus for making metal splats.
Figure 2:
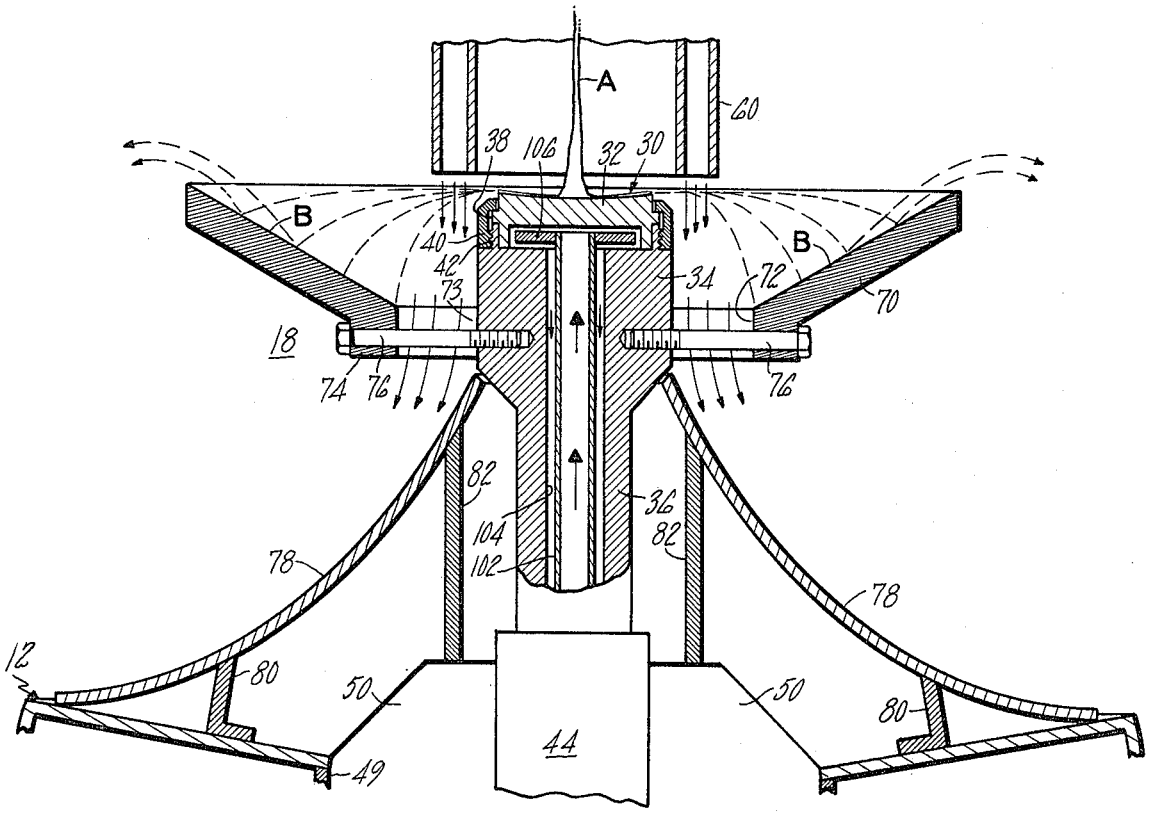
FIG. 2 is an englarged view of the rotating portion showing the rotary atomization means with the associated conical splat plate along with the annular coolant fluid nozzle and lower deflection plate.

The apparatus shown in FIG. 1 sets forth an apparatus for making metal splats. A housing 1, capable of being placed under a vacuum, is shown having a center cylindrical section 2, a top 4, and a bottom 6. The top has an access cover 8 connected thereto and the bottom 6 has a bottom connector 10 for directing metal particles away from said housing 1. The bottom 6 has an inner body 12 mounted therein for a purpose to be hereinafter described.

The center cylindrical section 2 has a nozzle plate means 14 dividing the housing into an upper chamber 16 and a lower chamber 18. The nozzle plate means 14 has a central opening 20 through which liquid metal passes in a stream into the lower chamber 18. A crucible and associated liquid heating means can be located in the upper chamber 16 as shown in U.S. Pat. Nos. 4,025,249; 4,053,264; and 4,078,873. The specific manner of heating and pouring the liquid metal through the central opening 20 does not form the inventive portion of this disclosure.

A rotating disc, or atomizer rotor, 30, is mounted for rotation in the lower chamber 18 with the center of the disc being positioned under the central opening 20. The rotating disc, or atomizer rotor, 30, is formed in a manner similar to that shown in U.S. Application Ser. No. 862,898, filed Dec. 21, 1977 for Rotary Atomization Means for the Production of Metal Powder. This atomization means 30 comprises a disc 32 fixedly mounted to the top of the enlarged head 34 of a drive shaft 36. As in the patent referred to, the rotating disc 32 has a radially extending flange 38 which is engaged by a hold-down nut 40 which is threadably mounted to an upwardly extending cylindrical flange 42 on the enlarged head 34. While this atomizer rotor has been described, other atomizer rotors may be used. Other atomizer rotors are shown in U.S. Pat. Nos. 2,062,093 and 4,027,718.

Drive shaft 36 is mounted for rotation in the lower chamber 18 in an upstanding cylindrical pedestal 44. An air turbine device for rotating the drive shaft 36 and atomization means 30 is located within the pedestal 44. Air for driving the air turbine device is directed thereto through conduit 46 and is directed away therefrom by conduit 48. Other rotor driving means can be used if desired. The speed of the drive shaft 36 is determined by the flow of air directed through conduit 46. This can be controlled by one of many well known devices 47 for directing air to the conduit 46.

The pedestal 44 is fixed to the sides of an inner opening 49 at the center of the inner body 12 by support vanes 50. Inner body 12 is fixed within the bottom 6 of housing 1 by a plurality of larger support vanes 52. This spacing by vanes 52 provides for the main flow of metal particles from the atomizing means 30 to the bottom connector 10.

The nozzle plate means 14 has an annular nozzle 60 fixed thereto and extending downwardly concentric with the central opening 20 on nozzle plate means 14. A conical splat plate 70 is fixed to the bottom portion of the enlarged head 34 of drive shaft 36. The conical splat plate 70 has an opening 72 at the center thereof with a short cylindrical section 74 extending downwardly therefrom. A plurality of bolts 76 extend through openings in the short cylindrical section 74 and are threadably secured to openings in the outer surface of the enlarged head 34; this provides a substantially annular passageway 73 between the opening 72 in the conical splat plate 70 and outer surface of the enlarged head 34. The bottom of the annular nozzle 60 is positioned above and radially outwardly from the atomization means 30 and the enlarged head 34 so that an annular jet of cooling fluid therefrom passes adjacent the atomization means 30 and enters the substantially annular opening 73. An annular deflector shield 78 is mounted on the top of the inner body 12 by sets of standoffs 80 and 82. It can be seen that an annular jet exiting from the nozzle 60 will pass the outer edge of the atomization means 30, pass through the annular opening 73 and be directed by the deflector shield 78 to the spacing between the inner body 12 and bottom 6 of housing 1 for flow to the bottom connector 10. This connector 10 can be connected to any type of collector or separator means by a pipe 90.

A coolant supply means 92 is connected to an annular manifold 62 by a conduit 94 having valve means 96. Manifold 62 is connected to annular nozzle 60 by a plurality of passageways, or conduits, 98, in nozzle plate means 14. Control valve means 96 can control the flow to the annular manifold 62 as desired.

A coolant supply means 100 is connected by a conduit 101 to a conduit 102, by a rotating seal means, located within drive shaft 36 which has a passageway 104 extending through the center thereof. An annular disc 106 is placed in an opening formed between the top of the shaft 36 and disc 32 with the conduit 102 fixed around the center opening in the annular disc 106. Passageway 104 is in turn connected by a rotating seal means to a conduit 108 which directs the cooling fluid to a point exterior of the housing 1. It can be seen that the cooling fluid from supply means 100 passes up through the center of the conduit 102, passes around the annular disc 106 and is returned downwardly between the conduit 102 and passageway 104 to the conduit 108. This is similar to the system shown in U.S. Application Ser. No. 862,898.

Figure 3:
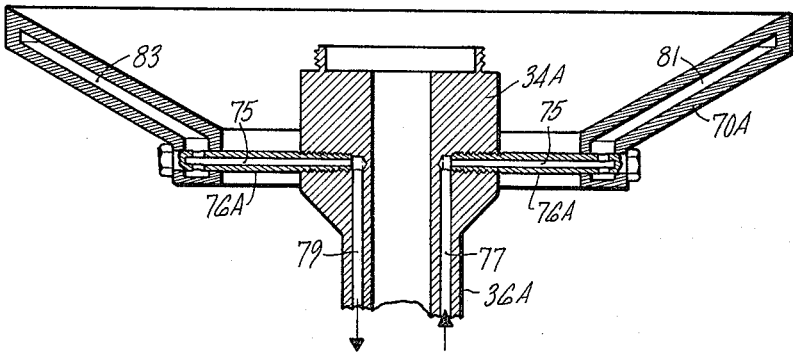
FIG. 3 is a view of the conical splat plate of FIG. 2 showing a modification for routing a cooling fluid through the plate.

Further, cooling means can be provided for the conical splat plate 70. A modified conical splat plate 70A is shown in FIG. 3 wherein the bolts 76A are formed having a passageway 75 therein which will transfer a cooling fluid through the bolts. Separate passageways 77 and 79 are placed in drive shaft 36A with passageways 77 delivering a cooling fluid to one-half of the passageways 75 of bolts 76A and with passageways 79 receiving flow from the passageways 75 of the remaining bolts 76A. Passageways 81 carry fluid from the passageways 77 and 75 into the conical splat plate 70A and they are connected at their outer edge to passageways 83 directing the cooling fluid inwardly to the passageways 75 and 79. While passageways 77 could be connected to conduit 102 and passageways 79 could be connected to the space between conduit 102 and passageway 104 of drive shaft 36 to use the coolant supply means 100, a separate coolant supply means could be used if desired.

During operation of the apparatus, a liquid metal stream A is broken up into fine droplets by the atomization means 30 and the liquid metal droplets leave the rim of the disc 32 in a horizontal plane. An annular gas jet flowing through the annular nozzle 60 flows normal to the plane of the particles leaving the disc 32 and it deflects the heavier liquid metal droplets to the conical splatting inner surface B of the conical splat plate 70 where the liquid metal droplets splat and cool extremely fast. As they cool, they shrink from the surface B and are ejected by the action of centrifugal force. The gas jet also removes the smaller gas-quenched particles through the substantially annular passageway 73. The deflector shield 78 deflects any metal particles away from the top of the pedestal 44 to prevent particles from entering thereinto.

It is noted that the means for controlling the jet flow through annular nozzle 60 can be varied independently from the speed of the atomization means 30. This would permit the shifting of the location of liquid metal droplets splatting on the surface B of the conical splat plate 70. Further, the atomization means 30 and the drive shaft 36 can be cooled when desired, as can the conical splat plate 70.

I claim:

1. An apparatus for producing cooled metal splats including means for melting metal, a shaft mounted for rotation, a disc means mounted for rotation on said shaft, a conical splat plate means located around said disc means, means for pouring molten metal on said disc means, means for rotating said disc means for flinging said molten metal outwardly as droplets, and means for projecting a moving annular curtain of cooling fluid downwardly around said disc means for deflecting said droplets against said conical splat plate means to form cooled metal splats wherein said conical splat plate means is spaced from said shaft providing an annular space, said annular space being located under said annular curtain of cooling fluid so that it passes through said annular space.

2. An apparatus as set forth in claim 1 wherein said conical splat plate means is mounted for rotation.

3. An apparatus as set forth in claim 1 wherein said disc means and said conical splat plate means are both mounted on the same rotating means.

4. An apparatus as set forth in claim 1 including means for cooling said conical splat plate means.

5. An apparatus as set forth in claim 1 wherein deflector means are positioned below said conical splat plate means for directing cooled metal particles and said cooling fluid toward a particle collecting means.

6. An apparatus as set forth in claim 1 wherein said means for projecting a moving annular curtain of cooling fluid downwardly around said disc means includes control means for controlling the flow of said cooling fluid to obtain a desired positioning of the location of liquid metal droplets splatting on the conical splat plate means.

7. An apparatus as set forth in claim 1 wherein said means for projecting a moving annular curtain of cooling fluid downwardly around said disc means removes the smaller particles through said annular space.

8. A method of forming metal splats, (1) melting metal from which splats are to be made,
(2) flinging said liquid molten metal outwardly as droplets,
(3) positioning a splat surface outwardly from where said liquid molten metal droplets are flung out,
(4) blowing a gas downwardly on said molten liquid droplets and through an annular space inwardly of splat surface to deflect them the droplets toward said splat surface,
(5) splatting said droplets on said splat plate where they flatten and cool, and
(6) rotating said splat surface to insure ejection of formed splats.

9. A method as set forth in claim 8 including the following step:

(7) controlling the gas blowing downwardly on said molten liquid droplets to obtain a desired positioning of the location of liquid metal droplets splatting on said splat plate.

10. A method as set forth in claim 8 wherein step (4) said gas blowing downwardly carrying smaller particles away from said splat plate.

* * * * *